US007096950B2

(12) United States Patent
Howlett et al.

(10) Patent No.: US 7,096,950 B2
(45) Date of Patent: Aug. 29, 2006

(54) COMBINED MILLING AND SCRAPING TOOL

(75) Inventors: Paul David Howlett, Aberdeen (GB); George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 273 days.

(21) Appl. No.: 10/415,170

(22) PCT Filed: Oct. 26, 2001

(86) PCT No.: PCT/GB01/04742

§ 371 (c)(1),
(2), (4) Date: Jul. 28, 2003

(87) PCT Pub. No.: WO02/35055

PCT Pub. Date: May 2, 2002

(65) Prior Publication Data

US 2004/0011528 A1 Jan. 22, 2004

(30) Foreign Application Priority Data

Oct. 27, 2000 (GB) ..... 0026460.6

(51) Int. Cl.
*E21B 29/00* (2006.01)
*E21B 37/02* (2006.01)

(52) U.S. Cl. ..... 166/298; 166/311; 166/55.7; 166/173; 166/175; 166/99; 15/104.16

(58) Field of Classification Search ..... 166/311, 166/312, 170, 173, 175, 99, 241.1, 241.6, 166/241, 298, 55.7; 15/104.05, 104.09, 104.15, 15/104.16
See application file for complete search history.

(56) References Cited

U.S. PATENT DOCUMENTS 2,470,743 A * 5/1949 Hochgesang et al. ..... 250/254
3,110,084 A * 11/1963 Kinzbach ..... 408/231
3,114,416 A * 12/1963 Kammerer ..... 166/55.7
3,547,191 A * 12/1970 Malott ..... 166/223
4,438,822 A * 3/1984 Russell ..... 175/325.5
4,603,739 A * 8/1986 Krugh ..... 166/311
4,896,720 A * 1/1990 DeRouen ..... 166/170
5,074,356 A * 12/1991 Neff ..... 166/55.7
6,152,220 A * 11/2000 Carmichael et al. ..... 166/173
6,530,429 B1 * 3/2003 Howlett ..... 166/173
6,758,275 B1 * 7/2004 Martin ..... 166/311

(Continued)

FOREIGN PATENT DOCUMENTS

GB 2340862 A 3/2000

(Continued)

*Primary Examiner*—David Bagnell
*Assistant Examiner*—Shane Bomar
(74) *Attorney, Agent, or Firm*—C. Dean Domingue; Robert L. Waddell; Ted A. Anthony

(57) ABSTRACT

A downhole tool (1) for providing the dual role of cleaning and milling within a wellbore casing or liner is described. In an embodiment scraper blades (6) are mounted on a body (2) together with a milling sleeve (4). Additionally, a centralizer sleeve (3) is incorporated as is a filter and/or junk basket for collecting debris is dislodged from the casing or liner during the cleaning and milling operation. The milling sleeve (4) can be locked onto the body (2) while the cleaning members e.g. scraper blades (6) may be free floating around the tool (1).

16 Claims, 2 Drawing Sheets

U.S. PATENT DOCUMENTS

| | | | | |
|---|---|---|---|---|
| 6,896,064 | B1 * | 5/2005 | Howlett et al. | 166/387 |
| 2002/0005284 | A1 * | 1/2002 | Allen | 166/173 |
| 2003/0201102 | A1 * | 10/2003 | Mackenzie et al. | 166/250.08 |
| 2005/0022995 | A1 * | 2/2005 | Martin et al. | 166/311 |
| 2005/0230108 | A1 * | 10/2005 | Mackenzie et al. | 166/250.01 |

FOREIGN PATENT DOCUMENTS

| | | | |
|---|---|---|---|
| WO | WO 9743517 | A1 * | 11/1997 |
| WO | WO 00/58602 | | 10/2000 |
| WO | WO 2004085787 | A2 * | 10/2004 |

* cited by examiner

COMBINED MILLING AND SCRAPING TOOL

This patent application claims an international filing date of 26 Oct. 2001 and a priority date of 27 Oct. 2000.

BACKGROUND OF THE INVENTION

The present invention relates to a combined milling and cleaning tool intended for use in downhole environments.

It is a common procedure during the completion of a well to line the newly drilled bore with casing or liner, the latter typically being used near the production area of the bore. Casing, which is usually made of heavy steel piping, is used to prevent collapse of newly drilled bore segments and contamination of the oil or gas reservoir contained therein. Typically the casing or liner is run into the bore from the surface and held in place by introducing cement between the external surface of the casing or liner and the internal surface of the wellbore, with each section of the bore being drilled with consecutively smaller drill bits and then lined with proportionately smaller casing or liner sections.

It will be appreciated that after cementing the casing or liner in place, it is often necessary to clean the interior of the casing or liner to remove obstructions such as burrs or lumps of cement which remain within the tubing after the cementing procedure. A commonly used cleaning tool, well known to the art, is a casing scraper which incorporates blades typically made of a resilient material such as steel. The blades are used to scrape the interior surface of the casing or liner. Milling tools are also well known in the art and are used to "dress off" the polished bore receptacle liner top in a new wellbore. Milling removes burrs, and grinds the polished bore receptacle to allow smooth and easy entry of subsequent tools through the liner. Milling tools are also commonly used to remove casing present in a wellbore if said casing is damaged in any way. Milling tools provide a cutting or grinding action and are necessarily formed from a material which is hard enough to cut or grind the liner top, which is a machine steel tube. Often, the tool is produced with carbide inserts as this material is hard enough to mill casing or liner steel.

Historically when completing a bore using a scraper and milling tool, the scraping tool is run into the wellbore on a work string to clean the interior of the casing. This first tool must then be removed or "tripped" from the bore before the milling tool can be run to tidy up or "dress off" the liner top. As a consequence, the cost and time taken to finish the bore is increased as it is necessary to perform two trips down the well.

Previous attempts to run milling tools and scrapers into a wellbore at the same time have encountered problems, as it is usual for the combined milling and scraping action to dislodge and create additional debris within the casing and liner. This is typically suspended in the well fluid in the bore and negates much of the cleaning which is carried out. It has therefore still been necessary when carrying out a combined operation to run a second trip down the well to clean the wellbore before production is commenced.

It would be very desirable to be able to run a cutting and a milling tool together in one operation, eliminating at least one trip into and out of the borehole to finish said bore, as the beginning of profitable production will not be delayed.

It is an object of the present invention to provide an improved tool for use when completing a downhole wellbore. In particular is an object of the present invention to provide a tool, which can carry out milling and scraping functions at the same time.

SUMMARY OF THE INVENTION

According to the present invention there is provided a downhole tool for mounting on a work string, wherein the tool comprises an elongate body having a plurality of cleaning members, and wherein the tool also comprises means for milling casing or liner.

Preferably the tool also comprises means for cleaning well fluid.

Optionally said means for cleaning well fluid is a junk basket.

Alternatively said means for cleaning well fluid may be filtration equipment.

Typically the cleaning members are scraper blades.

In the preferred embodiment the tool has a first and second sleeve.

Preferably the first sleeve acts as a stabiliser for the work string within the wellbore.

Preferably the second sleeve is a milling sleeve.

Preferably the tool has a floating component located between said first and second sleeve, wherein the floating component is free to move in a radial direction relative to the elongate body within predetermined limits set by the first and second sleeve.

Preferably the first and second sleeve have female receiving means for receiving the floating component.

Typically the plurality of cleaning members are supported on the floating component.

Preferably the centraliser sleeve is mounted by ball bearings that allow for the work string to rotate relative to the sleeve.

Preferably the milling sleeve is mounted by one or more lock studs that lock the milling sleeve both axially and rotationally with respect to the elongate body.

Example embodiments of the invention will now be illustrated with reference to the following figures in which:

DETAILED DESCRIPTION OF THE PREFERRED EMBODIMENTS

Figure 1:
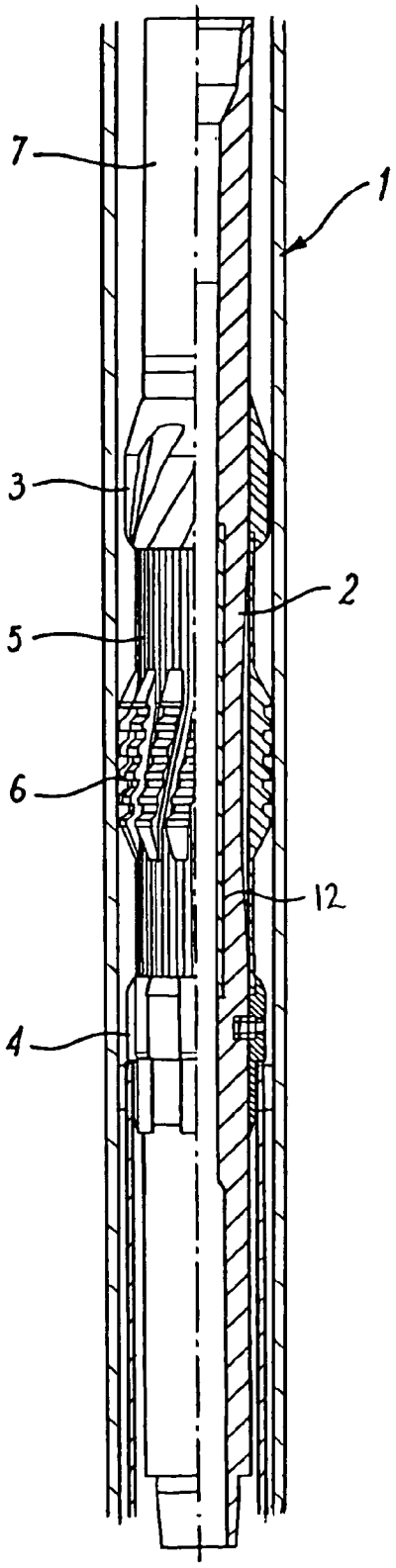
FIG. 1 shows a cross-section of a combined scraping and milling tool in accordance with the present invention.

Referring firstly to FIG. 1, the combined scraping and milling tool is generally depicted at 1. The tool 1 comprises an elongate body 2 having a first upper 3 and second lower 4 sleeve, and is run into a wellbore (not shown) which is lined by casing and liner, mounted on a work string 7.

The upper 3 sleeve of the tool 1 acts as a centraliser to maintain the tool 1 or work string 2 in a central position within the wellbore, whilst the lower sleeve 4 is a milling sleeve. Typically the milling sleeve is comprised of carbide inserts which are impregnated into a steel sleeve, which are hard enough to mill or grind the liner top in the wellbore. On rotation of the work string the milling sleeve 4 smooths the entrance to the liner top polished bore receptacle.

The tool 1 also comprises a floating component 5 between the upper 3 and lower 4 sleeve. The floating component is a lantern which supports a plurality of scraper blades 6. The scraper blades 6 scrape the casing which is near to and directly above the polished bore receptacle. It will be appreciated from FIG. 1 that the scraper blades are mounted in close proximity to where milling of the liner top takes place.

Figure 2A:
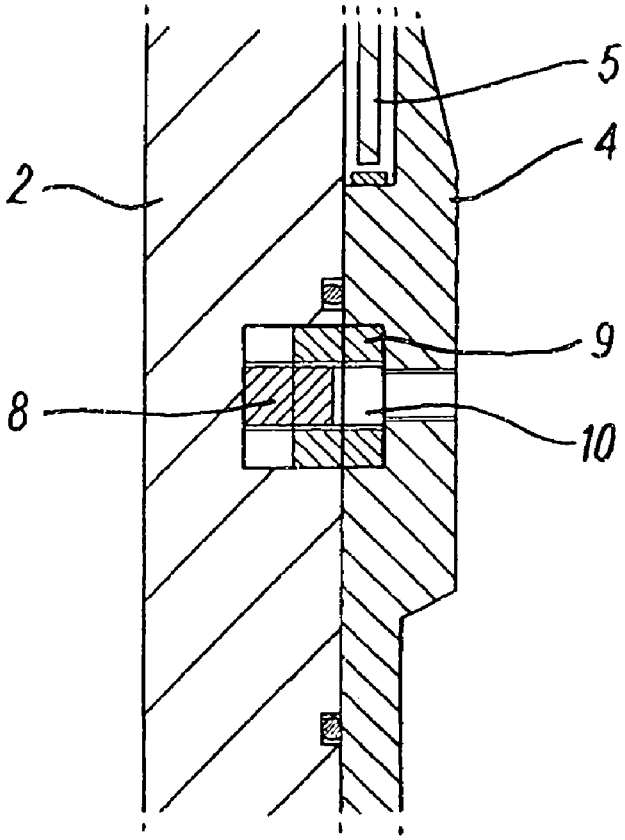
FIGS. 2A and 2B are close-ups of the locking system, which fixes the milling sleeve to the combined scraping and milling tool shown in FIG. 1.
Figure 2B:
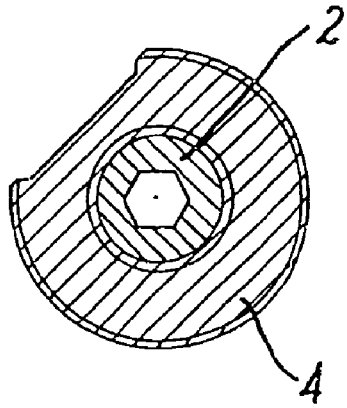

FIGS. 2A and 2B show a section of the locking system which holds the milling sleeve 4 to the tool 1 in more detail. The locking system consists of three components, namely a hex-head grub screw 8, a lock stud 9 and PTFE plug 10. The lock stud is cylindrical and flat milled on one side. To mount the milling sleeve 4 on the elongate body 2, the lock stud 9 and grub screw 8 are assembled together flush, and inserted into corresponding holes milled in the elongate body 2 of the tool 1. The milling sleeve 4 is then slipped over the body 2 and secured by screwing down the grub screws 8. The lock studs 9 move rotationally by virtue of the screwing of the grub screws 8, and as a consequence the lock studs 9 back out into drilled countersunk holes in the milling sleeve 4 which locks the sleeve 4 both axially and rotationally with respect to the elongate body 2. As a consequence, the milling sleeve 4 has no or negligible rotational movement, notwithstanding rotation of the work string. A PTFE plug 10 is then inserted into the hole in the body 2 to act as a debris barrier.

The first upper sleeve 3 which centralises the work string 7 in the wellbore is mounted on the elongate body 2 by ball bearings which allow said upper sleeve 3 to rotate relative to the body 2.

It can be seen from FIG. 2A that the lantern 5 which supports the scraper blades sits within a recess in the lower milling sleeve 4. A corresponding recess (not shown) is located on the upper centraliser sleeve. The recess is greater in size than the lantern itself, and as a consequence the lantern 5 can move in a radial direction relative to the work string, but within the limits set by the recesses in the upper centraliser and lower milling sleeves.

In the preferred embodiment the tool 1 also comprises a means for cleaning the well fluid within the well. The fluid cleaning means may comprise filtration equipment 12 which may be provided in a variety of different embodiments. For example the filtration equipment may be a wire screen 12 which is appropriately sized to prevent particles of debris from passing through the body 2. It will be appreciated that the filtration equipment could also be comprised of, for example, permeable textile or holed tubes or cages. By providing said filtration equipment 12 the tool can filter debris particles from the well fluid.

Figure 3:
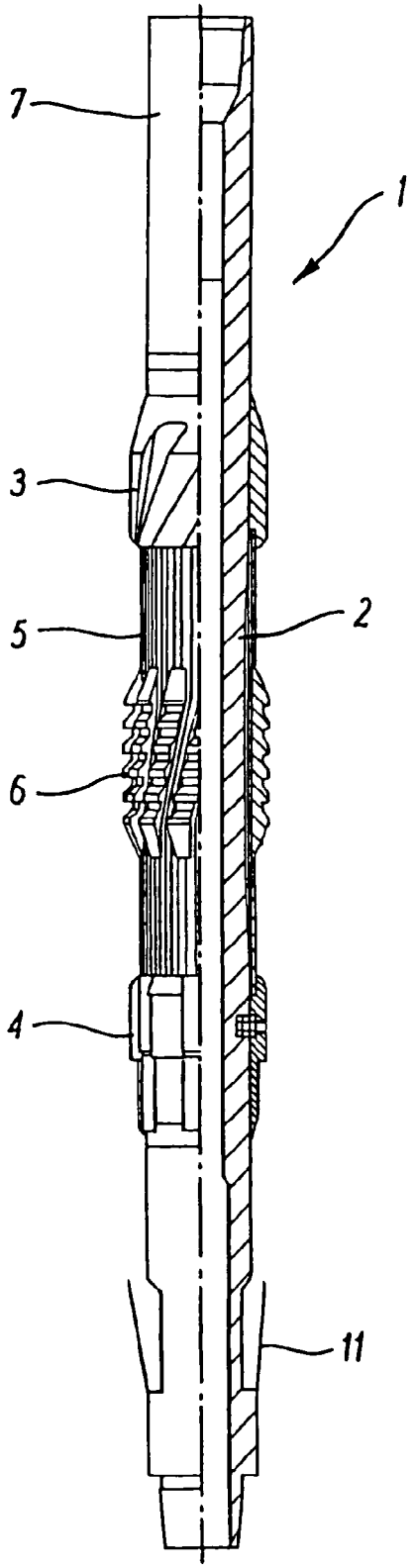
FIG. 3 shows a cross-section of a combined scraping and milling tool having a junk sub.

The tool 1 may alternatively have a junk-sub 11 to collect debris from the wellbore as shown in FIG. 3. In the embodiment shown, the junk sub 11 is positioned close to the milling sleeve 4 and scraper blades 6 and is hence used to collect debris which is liberated into the annulus of the casing or liner.

The advantage of the present invention is that the time taken for finishing a wellbore can be greatly reduced as there is no need to implement complex and timely retrieval operations to recover a milling or scraping apparatus from the bore prior to running the other of the milling or scraping component to the bore. As a consequence, profitable production can be begun much sooner. In particular, the tool of the present invention allows the liner top polished bore receptacle within a wellbore to be "dressed off" at the same time as the casing above the liner top is scraped and cleaned. This allows the finished wellbore to be cleaned to remove obstructions such as burrs or lumps of cement, and to smooth entry into the liner top. In the present invention this combination of scraping and milling can be carried out at the same time, and any debris dislodged by said actions will be removed from the well fluid by the filtration equipment or junk sub. There is therefore no need to run a second fluid cleaning tool into the wellbore after milling and scraping.

In addition, as the scraping members are positioned in close proximity to the milling sleeve, it is possible to set up a packer very close to the polished bore receptacle, in order to isolate a section of the wellbore.

Further modifications and improvements may be incorporated without departing from the scope of the invention herein intended. For example, the scraper blades may be replaced with other cleaning members as are known in the art eg brushes.

The invention claimed is:

1. A combined cleaning and liner milling tool for mounting on a work string, the tool comprising an elongate body having a plurality of cleaning members, the cleaning members dimensioned for cleaning an inner surface of a casing above a top of a liner located within the casing, and wherein the tool also comprises milling means having a milling surface shaped to mill and thereby smooth both an upper edge and an inner surface of the liner top, to thereby clean the casing and dress-off the liner top in a single tool run.

2. A tool according to claim 1 wherein the tool also comprises means for cleaning well fluid.

3. A tool according to claim 2 wherein said means for cleaning well fluid is a junk basket.

4. A tool according to claim 2 wherein said means for cleaning well fluid is filtration equipment.

5. A tool according to claim 1 wherein the cleaning members are scraper blades.

6. A tool according to claim 1 wherein the tool has a first and second sleeve.

7. A tool according to claim 6 wherein the first sleeve is a centraliser sleeve and acts as a stabiliser for the work string within a wellbore.

8. A tool according to claim 7 wherein the centraliser sleeve is mounted to allow for the work string to rotate relative to the sleeve.

9. A tool according to claim 6 wherein the second sleeve is a milling sleeve.

10. A tool according to claim 9 wherein the milling sleeve is mounted by one or more lock studs that lock the milling sleeve both axially and rotationally with respect to the elongate body.

11. A tool according to claim 6 wherein the tool has a floating component located between said first and second sleeve, the floating component is free to move in a radial direction relative to the elongate body within predetermined limits set by the first and second sleeve.

12. A tool according to claim 11 wherein the first and second sleeves have female receiving means for receiving the floating component.

13. A tool according to claim 12 wherein the plurality of cleaning members are supported on the floating component.

14. A method of cleaning a casing and smoothing liner top within a wellbore, the method comprising the steps:

locating in the wellbore a combined cleaning and milling tool having cleaning members dimensioned for cleaning an inner surface of the casing above a top of a liner located within the casing and a milling surface shaped to mill and thereby smooth both an upper edge and an inner surface of the liner top;

b) moving the tool relative to the casing such that the cleaning members clean the casing above the liner top, and to locate the tool at the liner top; and c) further moving the tool relative to the casing, whereupon the milling surface smooths an upper edge and an inner surface of the liner top, to thereby effect the dual action of cleaning the casing and smoothing the liner top by milling in a single tool run.

15. The method of claim 14 including the step of cleaning well fluid in the wellbore.

16. The method of claim 14 including the step of collecting debris during the cleaning and milling action.

* * * * *